US006132250A

United States Patent [19]

Shinozaki et al.

[11] Patent Number: 6,132,250

[45] Date of Patent: Oct. 17, 2000

[54] CONNECTOR WITH SEALING MEMBERS

[75] Inventors: Tetsuya Shinozaki; Kouji Nemoto, both of Yokkaichi, Japan

[73] Assignee: Sumitomo Wiring Systems, Ltd., Japan

[21] Appl. No.: 09/243,323

[22] Filed: Feb. 2, 1999

[30] Foreign Application Priority Data

Feb. 6, 1998 [JP] Japan ..... 10-026236

[51] Int. Cl.[7] ..... H01R 13/40

[52] U.S. Cl. ..... 439/587; 439/942; 439/936

[58] Field of Search ..... 439/587, 607, 439/578–585, 609, 271–283, 610, 557, 567, 942, 936

[56] References Cited

U.S. PATENT DOCUMENTS

| | | |
|---|---|---|
| 4,824,390 | 4/1989 | Crane et al. . |
| 4,875,870 | 10/1989 | Hardy et al. . |
| 5,222,909 | 6/1993 | Nomura et al. . |
| 5,279,507 | 1/1994 | Kameyama . |
| 5,300,734 | 4/1994 | Suzuki . |
| 5,437,563 | 8/1995 | Kihira et al. . |
| 5,655,933 | 8/1997 | Skowronski . |

FOREIGN PATENT DOCUMENTS

| | | |
|---|---|---|
| 0 440 417 | of 1991 | European Pat. Off. . |
| 2 582 159 | of 1986 | France . |
| 4-101380 | of 1992 | Japan . |

*Primary Examiner*—Neil Abrams
*Assistant Examiner*—J. F. Duverne
*Attorney, Agent, or Firm*—Anthony J. Casella; Gerald E. Hespos; Michael J. Porco

[57] ABSTRACT

A connector is provided to prevent gelatinous seal members from being adhered to terminal fittings and improve the insertion operability of the terminal fittings. The connector includes a housing 11 with a rear surface that is held watertight since clearances between a cover 23 and the housing 11 and between the cover 23 and wires 15 are sealed by gelatinous seal members 40. Thus, female terminal fittings 14 are not brought into contact with the gelatinous seal members 40 while being inserted. Therefore, there is no likelihood that the gelatinous seal members 40 are adhered to the female terminal fittings 40 and that the viscosity resistance thereof acts on the female terminal fittings 14.

14 Claims, 8 Drawing Sheets

CONNECTOR WITH SEALING MEMBERS

BACKGROUND OF THE INVENTION

1. Field of the Invention

The present invention relates to a connector which prevents the entrance of water by using a seal member, preferably a gelatinous seal member.

2. Description of the Prior Art

A known connector, which prevents the entrance of water by using a gelatinous seal member, is disclosed in Japanese Unexamined Utility Model Publication No. 4-101380. This prior art connector is shown in FIG. 8, and includes a sheet-shaped gelatinous seal member 3 at a rear portion of a housing 1 where a terminal insertion opening 2 is formed. Terminal fittings 4 penetrate the layer of the gelatinous seal member 3 during their insertion into the housing 1. After the terminal fittings 4 have been inserted, the gelatinous seal member 3 adheres to the outer surfaces of wires 5 that are connected with the terminal fittings 4 and that are drawn out of the housing 1 through the terminal insertion opening 2. In this way, the interior of the housing 1 is held watertight.

In the above watertight construction, a part of the seal member, in particular the gelatinous seal member 3 may adhere to the terminal fittings 4 when the terminal fittings 4 penetrate the gelatinous seal member 3, thereby causing a connection defect with mating terminal fittings (not shown). Further, operability is poor since a large resistance acts on the terminal fittings 4 being inserted due to the viscosity of the gelatinous seal member 3.

In view of the above problems, an object of the present invention is to prevent the adhesion of a seal member to terminal fittings and to improve the insertion operability of the terminal fittings.

SUMMARY OF THE INVENTION

A connector according to the invention comprises a housing having a first or female housing with one or more terminal insertion openings, and a second or male housing substantially fittable on the outer surface of the female housing. One or more terminal fittings are at least partially insertable into the housing through the terminal insertion openings. A water preventing means is provided for preventing the entrance of water through the terminal insertion openings and/or through clearances between the male and female housings. One or more wires are connected or are connectable with the terminal fittings and are or can be drawn out of the housing through the terminal insertion openings. The water preventing means comprises: a substantially tubular cover which is mountable on the housing with the terminal fittings inserted. The tubular cover substantially covers the terminal insertion openings.

One or more seal members are provided for sealing clearances between the cover and the housing and a seal member is provided for sealing clearances between the cover and the wires. The tubular cover is fittable to the male housing to cover the terminal insertion openings after the terminal fittings have been inserted and with the male and female housings connected and having the wires inserted therethrough. The seal members seal clearances between the cover and the male housing, and thus the terminal insertion openings are held watertight. Since the terminal fittings are not brought into contact with the seal members while being inserted, there is no likelihood that the seal member is adhered to the terminal fittings and there is no likelihood that the viscosity resistance of the seal member acts on the terminal fittings.

According to a preferred embodiment of the invention, one or more wires are connected or are connectable with the terminal fittings and are or can be drawn out of or inserted into the housing through the terminal insertion openings. The water preventing means further comprises a seal member for sealing clearances between the cover and the wires. The terminal insertion openings are held watertight since the clearances between the cover and the wires are sealed by the seal members.

According to the invention, there is further provided a connector, comprising a housing with one or more terminal insertion openings. One or more terminal fittings are at least partially insertable into the housing through the terminal insertion openings. A water preventing means is provided for preventing the entrance of water through the terminal insertion openings. One or more wires are connected or are connectable with the terminal fittings and are or can be drawn out of the housing through the terminal insertion openings. The water preventing means comprises a substantially tubular cover which is mountable on the housing with the terminal fittings inserted therein and substantially covers the terminal insertion openings. One or more seal members are provided for sealing clearances between the cover and the housing, and a seal member is provided for sealing clearances between the cover and the wires. The tubular cover comprises one or more engaging portions that project at an angle different from 0° or 180° from a distal portion of the cover for an engagement with the housing, in particular with one or more ribs formed thereon.

According to a preferred embodiment, the engaging portions can be brought into contact with the seal members in a direction arranged at an angle different from 0° or 180°, preferably substantially normal with respect to an mounting direction of the cover with the housing.

Preferably, the seal members are gelatinous seal members. Accordingly, the watertightness of the connector can be improved.

Most preferably, the housing comprises a female housing provided with terminal insertion openings, and a male housing fittable on the outer surface of the female housing. The tubular cover is fittable to the male housing in such a manner as to substantially cover the terminal insertion openings with the terminal fittings inserted and with the male and female housings connected and preferably having the wires inserted therethrough. The seal members seal clearances between the cover and the male housing.

According to a further preferred embodiment, there is provided a connector, comprising a female housing with terminal insertion openings. Terminal fittings are insertable into the female housing through the terminal insertion openings. Wires are connected with the terminal fittings and are drawn out of the female housing through the terminal insertion openings. A male housing is fittable on the outer surface of the female housing from an opposite side of the terminal insertion openings. A water preventing means is provided for preventing the entrance of water through clearances between the terminal insertion openings and the male and female housings. The water preventing means comprises a tubular cover which is fittable on the outer surface of the male housing in such a manner as to cover the terminal insertion openings with the terminal fittings inserted and with the male and female housings connected and having the wires inserted therethrough. Gelatinous seal members seal clearances between the cover and the male housing and between the cover and the wires.

The connector is held watertight since the clearances between the cover and the male housing and between the cover and the wires are sealed by the gelatinous seal members and the terminal insertion openings are covered by the cover. Since the terminal fittings are not brought into contact with the gelatinous seal members while being inserted, there is no likelihood that the gelatinous seal member will be adhered to the terminal fittings and no likelihood that the viscosity resistance of the gelatinous seal member will act on the terminal fittings. Further, there is no need to provide a separate seal member in a clearance at an engaging portion of the male and female housings.

According to still a further preferred embodiment, there is provided a connector, comprising a housing with terminal insertion openings. Terminal fittings are insertable into the housing through the terminal insertion openings. Wires are connected with the terminal fittings and are drawn out of the housing through the terminal insertion openings. A water preventing means is provided for preventing the entrance of water through the terminal insertion openings. The water preventing means comprises a tubular cover which is mountable on the housing with the terminal fittings inserted. The tubular cover covers the terminal insertion openings, and has the wires inserted therethrough. Gelatinous seal members seal clearances between the cover and the housing and between the cover and the wires.

The terminal insertion openings are held watertight since the clearances between the cover and the housing and between the cover and the wires are sealed by the gelatinous seal members. Since the terminal fittings are not brought into contact with the gelatinous seal members while being inserted, there is no likelihood that the gelatinous seal member is adhered to the terminal fittings and the viscosity resistance of the gelatinous seal member acts on the terminal fittings. Preferably, the cover comprises a pair of half-piece members which are so assembled as to hold the wires therebetween.

Since the cover comprises the pair of half-piece members for holding the wires therebetween, operability is better as compared with a case where the wires are inserted through the tubular cover.

The water preventing means may further comprise a seal member, preferably a gelatinous member, which is arranged or arrangeable between corresponding contact portions of the half-piece members.

An aligning member may be provided for aligning the wires substantially side by side at specified (predetermined or predeterminable) spacings is further provided. If the wires are aligned substantially side by side at specified spacings, no clearance enclosed only by the wires as in a case where three or more wires are bundled is produced. Thus, the gelatinous seal members securely seal the clearances between neighboring wires, presenting a high water preventing performance.

The cover preferably comprises housing positioning means for positioning the housing in a specified (predetermined or predeterminable) position. The positioning means may position the aligning member in such a position that one or more wires are held or holdable at substantially the same height as a wire opening through which the wires are or can be drawn from the cover.

The housing may further comprise a mount portion for being mounted to a casing, and the mount portion may be sealed by additional sealing means.

These and other objects, features and advantages of the present invention will become more apparent upon a reading of the following detailed description and accompanying drawings.

DETAILED DESCRIPTION OF THE PREFERRED EMBODIMENTS

A first embodiment of the invention is described with reference to FIGS. 1 to 6. According to this embodiment, three female connectors 10 are at least partially fitted or fittable into a male housing 30 as a unit and a cover 23 is provided as a water preventing means in common to the three female connectors 10.

Figure 1:
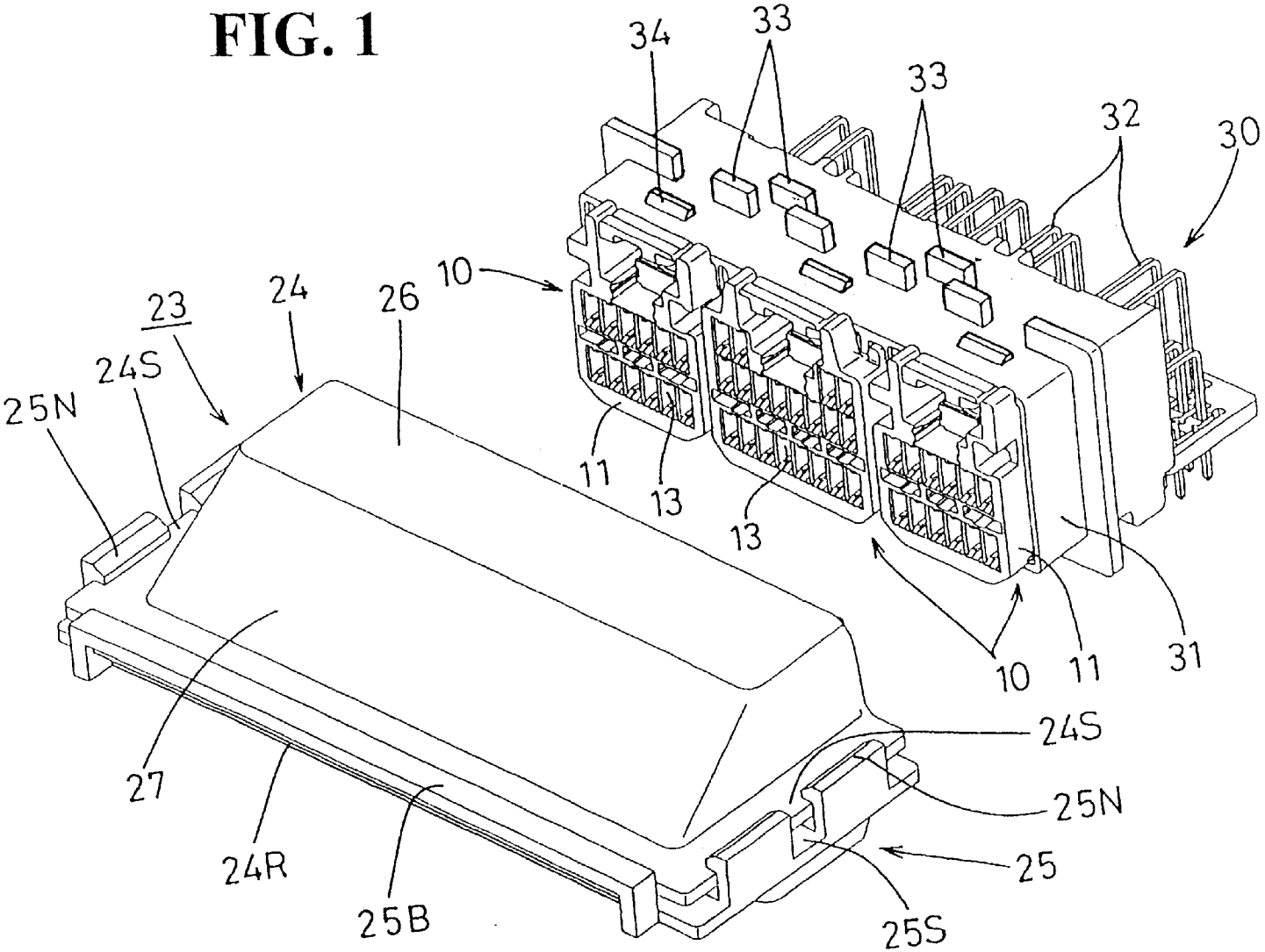
FIG. 1 is a perspective view of an assembly of male and female housings and a cover according to a first embodiment in a separated state.
Figure 2:
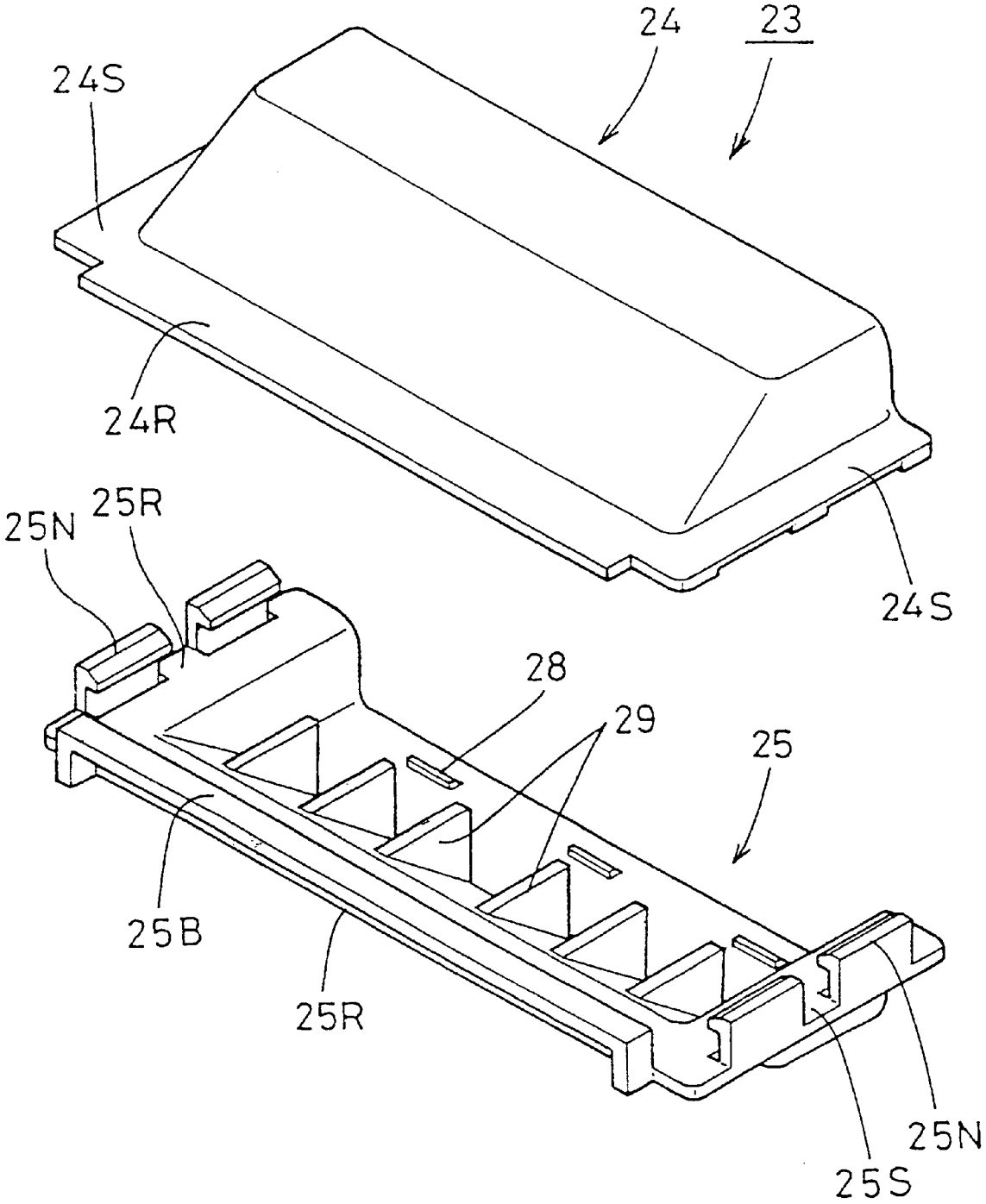
FIG. 2 is a perspective view of the cover in its separated state.
Figure 3:
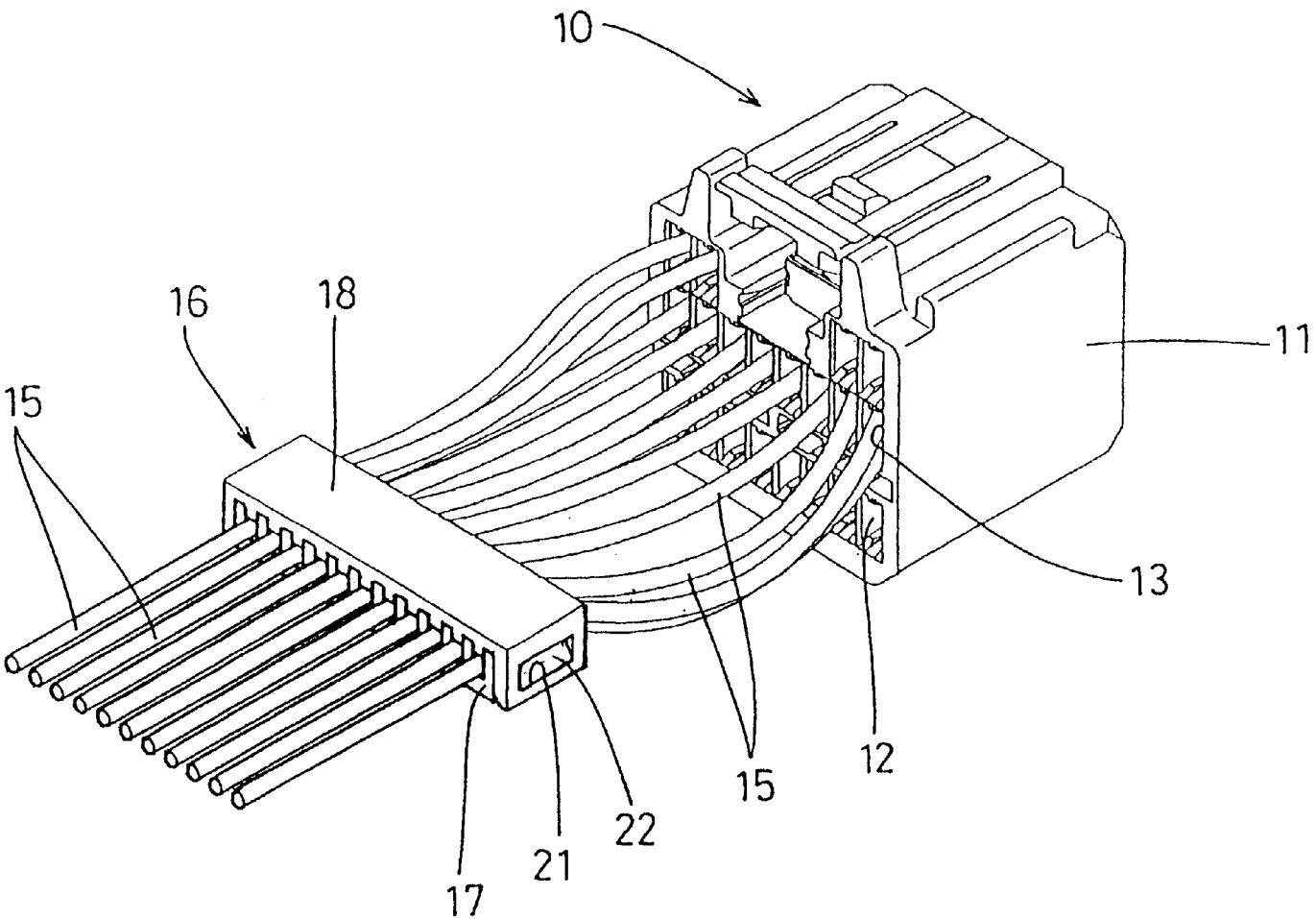
FIG. 3 is a perspective view showing a state where wires drawn from the female housing are aligned by an aligning member.
Figure 4:
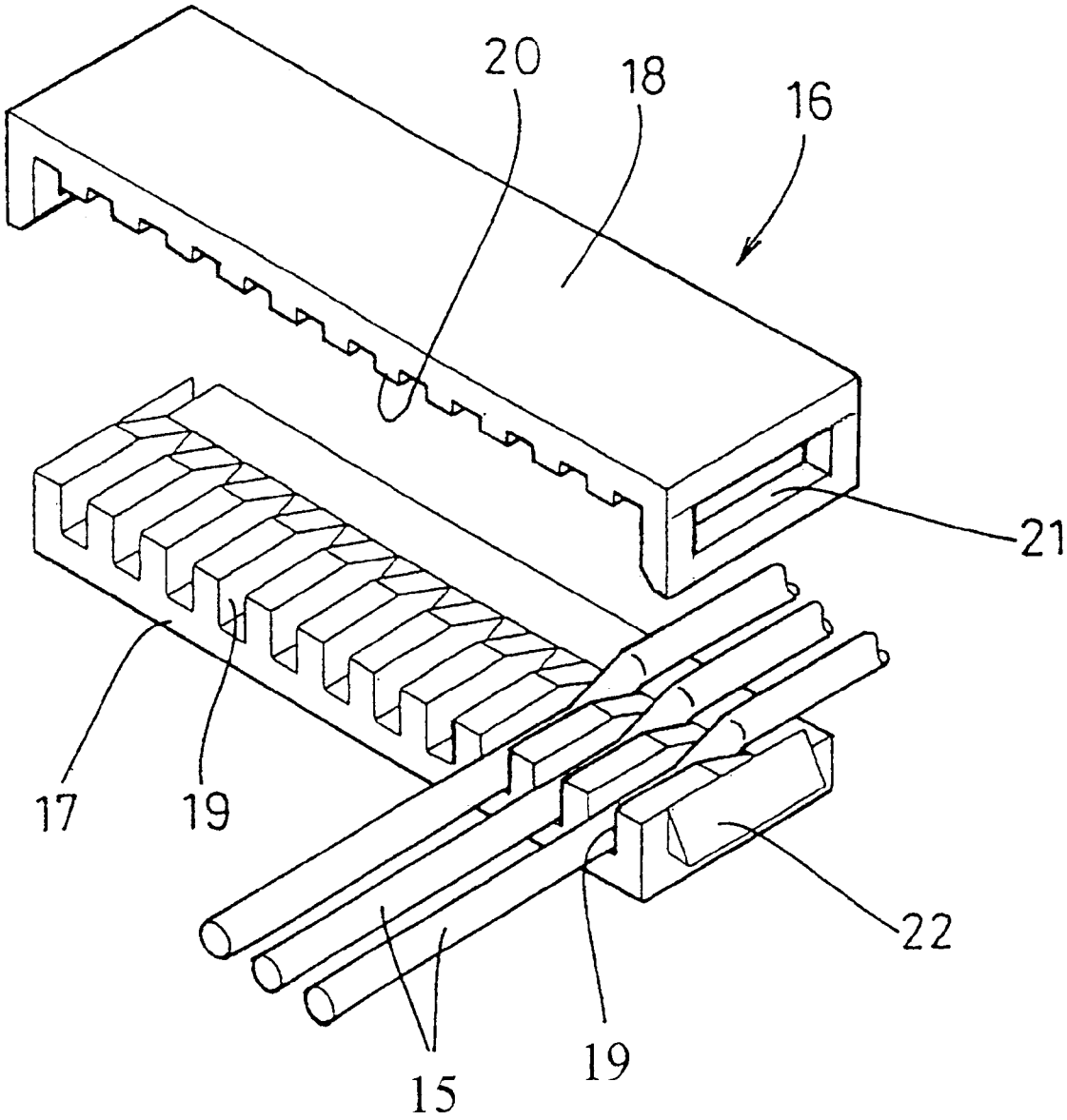
FIG. 4 is a perspective view of the aligning member in its separated state.
Figure 5:
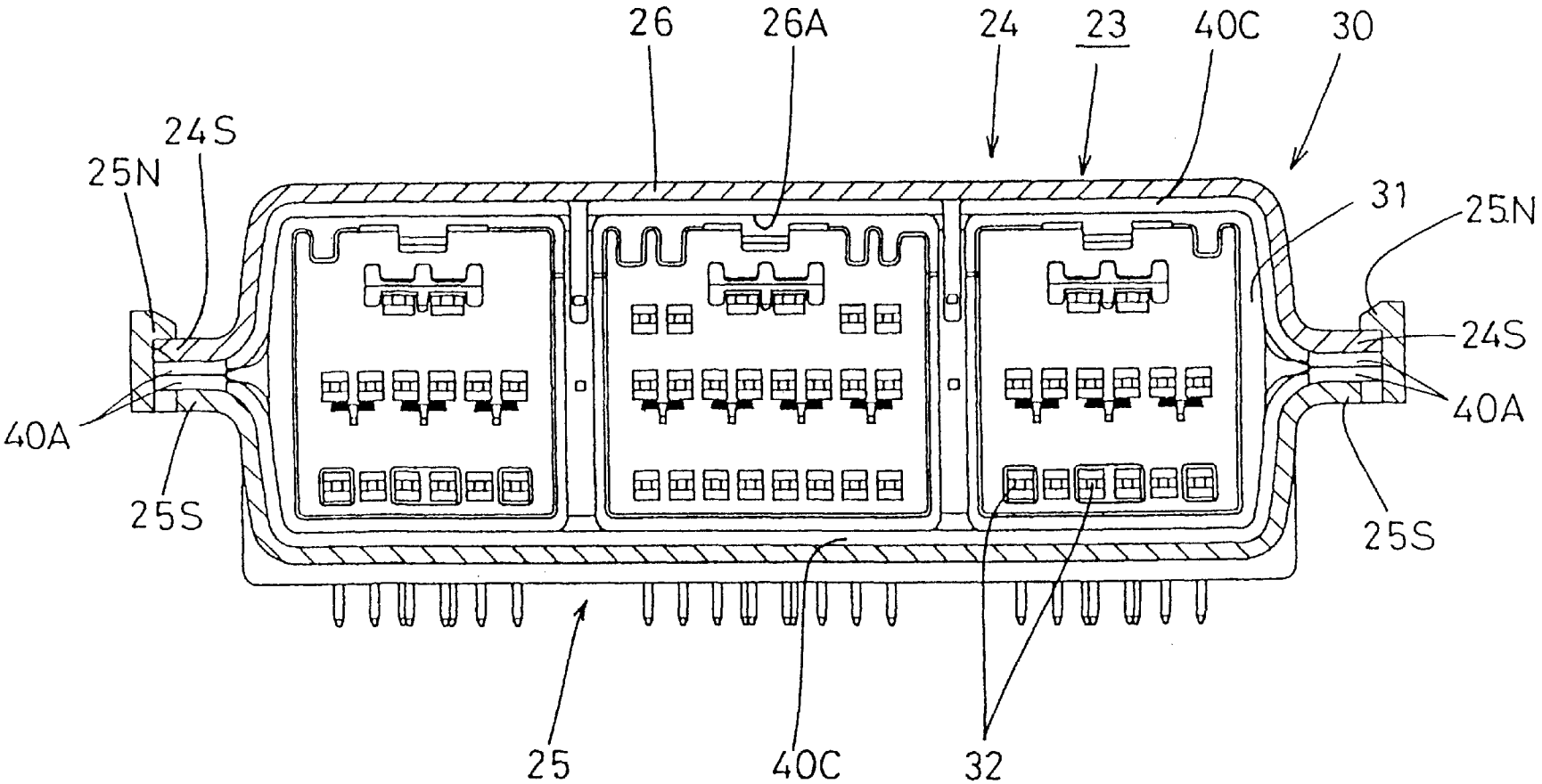
FIG. 5 is a horizontal section of the male housing assembled with the cover.

Each female connector 10 has a known construction comprised of a plurality of cavities 12, as shown in FIG. 3. More particularly, a female housing 11 has terminal insertion openings 13 of the respective cavities 12 formed preferably in its rear end surface. Female terminal fittings 14 are inserted into the respective cavities 12 through the terminal insertion openings 13 and are locked by unillustrated locking means so as not to come out. Wires 15 are connected with rear ends of the respective terminal fittings 14 and are drawn backward from the female housing 11 through the terminal insertion openings 13.

Each female connector 10 preferably is provided with an aligning member 16 (FIGS. 3 and 4) for substantially aligning a plurality of wires 15 drawn through the terminal insertion openings 13. The aligning member 16 is comprised of a laterally long receiving member 17 and a pressing member 18. A plurality of receiving grooves 19 are formed substantially side by side at substantially regular intervals in the upper surface of the receiving member 17, and pressing projections 20 corresponding to the receiving grooves 19 are formed in the lower surface of the pressing member 18. The respective wires 15 are fitted at least partially into the corresponding grooves 19 and the pressing member 18 is placed over the receiving member 17. The pressing member 18 and the receiving member 17 then are urged toward one another, such that the pressing projections 20 press the wires 15 into the grooves 19. As a result the wires 15 are aligned substantially side by side at substantially regular spacings. The pressing member 18 and the receiving member 17 are locked in their assembled state by the engagement of lock holes 21 and lock projections 22 provided at the opposite surfaces thereof.

On the other hand, the male housing 30 is formed with a receptacle 31 for substantially receiving the three female connectors 10, and leading ends of male terminal fittings 32 to be connected with the female terminal fittings 14 project into the receptacle 31. The male housing 30 is secured to a circuit board 36 substantially accommodated in a casing 35, and a front part of the receptacle 31 projects outwardly from a mount hole 37 of the casing 35.

Locking ribs or projections 33 formed on the outer surface of the receptacle 31 are engaged or engageable with the edge of the mount hole 37 at the front and rear (inner and outer) sides, and an unillustrated ring-shaped seal member is mounted or mountable at the edge of the mount hole 37. Accordingly, the entrance of water into the casing 35 through the mount hole 37 is substantially prevented and the casing 35 and the male housing 30 are fixed so as not to be loosely movable along forward and backward directions.

The female connectors 10 are fitted or fittable into the receptacle 31 of the male housing 30 to connect the male and female terminal fittings 32, 14 with each other.

Next, a means for substantially preventing the entrance of water at the terminal insertion openings 13 in the rear surface of the female connectors 10 and at an engaging portion of the male and female housings 11, 30 is described. This water preventing means is comprised of a tubular cover 23 and gelatinous seal members (e.g. silicone gel) 40A, 40B and 40C. The cover 23 includes upper or first and lower or second members (half-piece members) 24, 25 which are preferably substantially symmetrical or complementary. The members 24, 25 are put together such that side edges 24s of the upper member 24 are held between side edges 25S and claws 25N of the lower member 25, and such that a rear edge 24R of the upper member 24 is slipped at least partially under a beam portion 25B of the lower member 25. This prevents the upper and lower members 24, 25 from being spaced apart from each other along a vertical direction or a direction of separation and/or from being displaced along a transverse direction. A front half of the cover 23 acts as a connector receptacle 26 substantially in the form of a rectangular box, and a large engagement opening 26A is formed in the front end surface of the connector receptacle 26. On the other hand, a rear half of the cover 23 acts as a wire receptacle 27 which is tapered to have a substantially wedge-shaped cross section when viewed sideways while the width thereof is held substantially constant. A wire opening 27A in the form of a laterally long slit is formed in the rear end surface of the wire receptacle 27.

The connector receptacle 26 is fitted on the receptacle 31 of the male housing 30 with a small clearance left between it and the outer surface of the receptacle 31 and with the edge of the engagement opening 26A held substantially in contact with the front locking ribs 33. In this state, the disengagement of the cover 23 from the receptacle 31 is substantially prevented by the engagement of lock projections 28 inside the engagement opening 26A and receiving projections 34 on the outer surface of the receptacle 31.

The wires 15 and the aligning members 16 are or can be accommodated in the wire receptacle 27. Triangular pressing ribs 29 projecting from the inner surfaces of the upper and lower members 24, 25 tightly hold the aligning members 16 from above and below, respectively. Accordingly, the aligning members 16 and the wires 15 are held or holdable at substantially the same height as the wire opening 27A and a plurality of wires 15 are drawn from the cover 23 through the wire opening 27A while being aligned substantially side by side by the aligning members 16. Two pairs of pressing ribs 29 are provided on each of the upper and lower members 24, 25 for each aligning member 16.

The gelatinous seal members 40A, 40B, 40C are provided to sealably fill clearances between the upper and lower members 24, 25 of the cover 23, between the cover 23 and the wires 15 and/or between the cover 23 and the male housing 30.

Specifically, the sheet-shaped gelatinous seal member 40A is adhered to the lower surface of the side edge 24S of the upper member 24 and/or the upper surface of the side edge 25S of the lower member 25 in advance. When the two members 24, 25 are assembled, the gelatinous seal member 40A adhesively seals the clearance between the side edges 24S and 25S preferably due to its viscosity or by means of a glue or the like adhesive. The gelatinous seal member 40A may be adhered either to the side edge 24S of the upper member 24 or the side edge 25S of the lower member 25 in advance.

Further, the sheet-shaped gelatinous seal member 40B is adhered to the lower surface of the rear edge 24R of the upper member 24 and/or the upper surface of the rear edge 25R of the lower member 25. When the upper and lower members 24, 25 are assembled to substantially hold the wires 15 therebetween, the seal member 40B is sealably adhered to the outer surfaces of the wires 15 without leaving any clearance between the rear edges 24R, 25R while being so deformed as to substantially conform to the outer shape of the wires 15.

The provision of the gelatinous seal member between the pressing ribs 29 and the aligning members 16 prevents loose movements of the aligning members 16 along forward and backward or longitudinal directions and also along a transverse direction due to the viscosity of the seal member. Additionally the gelatinous seal member presents tension on the wires 15 from being transmitted to locking portions of the terminal fittings 14 and the cavities 12.

Figure 6:
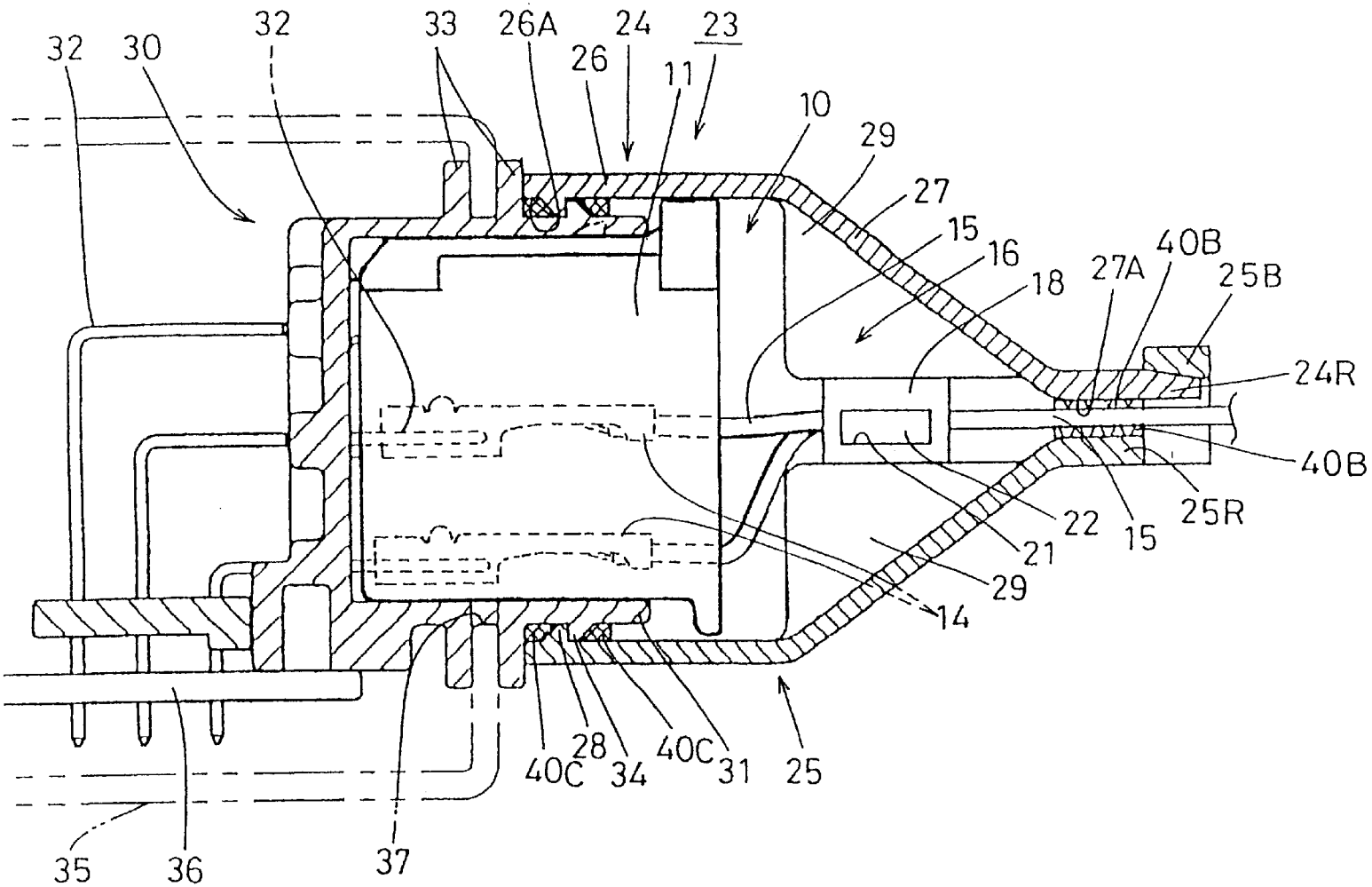
FIG. 6 is a vertical section of a connector in its assembled state.

Further, the ring-shaped gelatinous seal members 40C are adhered substantially to the entire circumference of the inner surface of the opening edge of the engagement opening 26A. Thus the seal members 40C adhere to the outer surface of the receptacle 31 when the upper and lower members 24, 25 are assembled onto the receptacle 31 for the terminal fittings 32, thereby sealing a clearance between the cover 23 and the receptacle 31 over the substantially entire circumference. The seal members 40C preferably are provided in two positions along the forward and backward directions (FIG. 6). The front or first seal member 40C is located between the lock projections 28 and the locking ribs 33 and the rear or second seal member 40C is located in a position to be adhered closely to the front slanting surfaces of the receiving projections 34. The seal members 40C may be adhered to the outer surface of the receptacle in advance.

Next, the operation of assembling the female connectors 10, connecting them with the male connector 30 and assembling the cover 23 is described. First, the female terminal fittings 14 connected with the wires 15 are inserted into the corresponding cavities 12 of the female connectors 10, and a plurality of wires 15 that have been drawn through the terminal insertion openings 13 are aligned substantially side by side by the aligning members 16. The female connectors 10, thus assembled, are at least partially fitted into the receptacle 31 of the male housing 30. The cover 23 is assembled by putting the upper and lower members 24, 25 together in such a manner as to hold the receptacle 31, the aligning members 16 and the wires 15 therebetween. In this way, the operation is completed.

In this state, the clearances between the upper and lower members 24, 25 at the side edges of the cover 23, between the wire opening 27A and the wires 15 at the rear edge of the cover 23, and between the engagement opening 26A of the cover 23 and the receptacle 31 are substantially sealed by the gelatinous seal members 40A, 40B, 40C, respectively. Thus, the entrance of water from the outside into the inside of the cover 23, i.e. into the insides of the housings 11, 30 and of the cover 35 substantially can be prevented.

As described above, since the clearances between the cover 23 and the female connectors 10 and between the cover 23 and the wires 15 are sealed by the seal members 40C, 40B in this embodiment, the entrance of water into the female housings 11 through the terminal insertion openings 13 can be prevented. Since the seal members 40A, 40B, 40C are not mounted to close the terminal insertion openings 13, the female terminal fittings 14 are not brought into contact with the seal members 40A, 40B, 40C while being inserted. Accordingly, the adhesion of the gelatinous seal member to the female terminal fittings 14 can be prevented, and the viscosity resistance of the seal members 40A, 40B, 40C does not act on the female terminals 14 being inserted.

Further, since the cover 23 is formed by assembling the two half-piece members: the upper and lower members 24, 25, operability is good because a cumbersome operation of introducing the wires 15 through the wire opening 27A is not necessary.

Furthermore, since the wires 15 are drawn from the cover 23 while being aligned and spaced substantially side by side by the aligning members 16, a clearance enclosed only by the wires 15, as in a case where three or more wires 15 are bundled, is not produced. Thus, the clearances between the neighboring wires 15 are securely filled by the seal member 40B, presenting a high water preventing performance.

In this embodiment, the cover 23 is fitted on the outer surface of the receptacle 31 into which the female connectors 10 are fitted without directly being connected with the female connectors 10 and the clearances between the cover 23 and the receptacle 31 are sealed by the seal members 40C. Accordingly, no sealing means is necessary between the female connectors 10 and the male housing 30.

Figure 7:
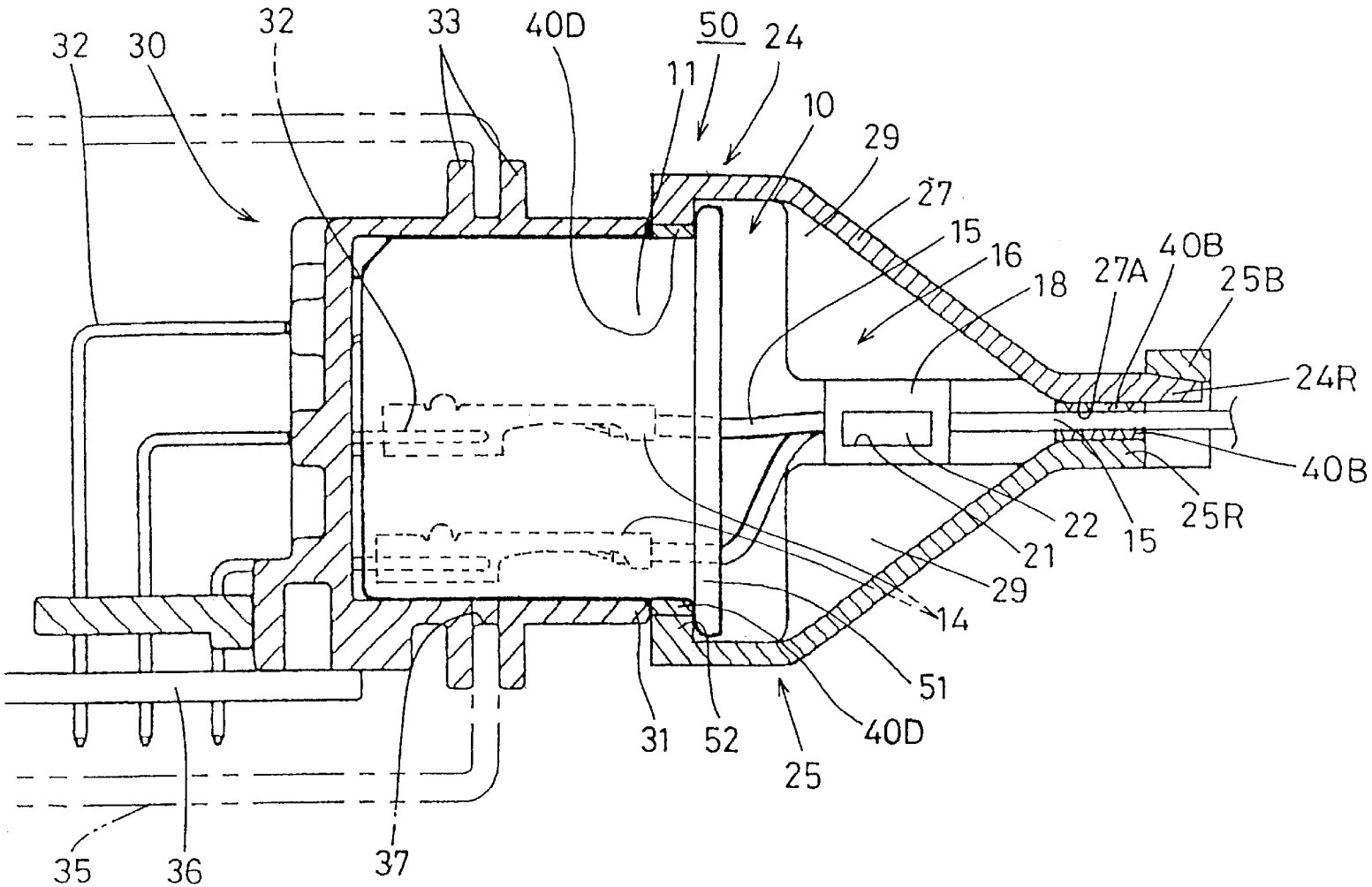
FIG. 7 is a vertical section of a second embodiment.
Figure 8:
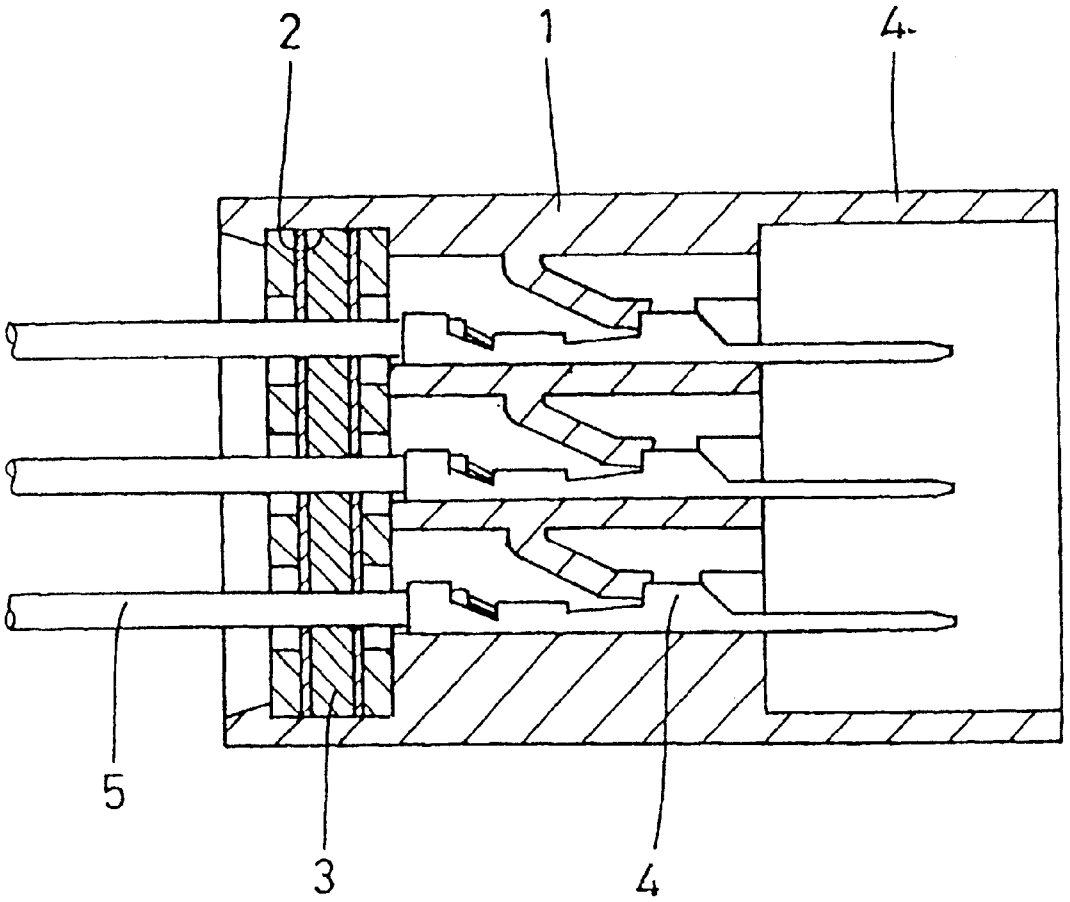
FIG. 8 PRIOR ART
FIG. 8 is a section of a prior art connector.

A second embodiment of the invention is described with reference to FIG. 7. In this embodiment, a cover has a construction different from that of the first embodiment. Since the other construction is same or similar as the first embodiment, no description is given on the structure, action and effects by identifying the same construction by the same or similar reference numerals.

As opposed to the first embodiment in which the cover 23 is fitted on the outer surface of the male housing 30, a cover 50 of the second embodiment is fitted on the outer surfaces of female housings 11. Thus, a mount rib 51 for locking the cover 50 is formed on the periphery of the rear surface of each female housings 11. On the other hand, an engaging portion 52 to be engaged with the mount rib 51 is formed on the inner surface of the cover 50. The engaging portion 52 preferably comes into contact with the mount rib 51 from a direction substantially parallel with an engaging direction of the cover 50 with the female housings 11, wherein the mount rib 51 preferably is positioned behind (with respect to the engaging direction) the engaging portion 52 in its mounted position (FIG. 7).

With the cover 50 mounted, a gelatinous seal member 40D is provided in a clearance between the outer surfaces of the female housings 11 and the inner surface of the cover 50, preventing the entrance of water into the female housings 11 through the terminal insertion openings 13. Preferably, the engaging portion 52 of the cover 50 comes substantially into sealing contact with the gelatinous seal member 40D to seal or close the clearances between the female housings 11 and the cover 50. Preferably, the engaging portion 52 comes into contact with the seal member 40D along a direction arranged at an angle different from 0° or 180°, preferably substantially normal with respect to the longitudinal direction or extension of the cover 50 and/or the female housing 11. The seal member 40D is preferably arranged along the complete outer contour or periphery of the female housing 11.

Further, an unillustrated seal member is provided in a clearance between the inner surface of the male housing 30 and the outer surfaces of the female housings 11, thereby preventing the entrance of water through this clearance.

The present invention is not limited to the described and illustrated embodiment, but the following embodiments are also embraced by the technical scope of the present invention as defined in the claims. Besides the following embodiments, a variety of other changes can be made without departing from the scope and spirit of the invention as defined in the claims.

Although the cover is made of two half-piece members in the foregoing embodiments, it may be an integral or unitary member according to the invention.

Although the wires are aligned side by side in the foregoing embodiments, they may be aligned in a plurality of stages or may be circularly bundled according to the invention.

Although the entrance of water into the female housings through the terminal insertion openings is prevented in the foregoing embodiments, the present invention is also applicable to a case where the entrance of water into the male connector through the terminal insertion openings is prevented.

What is claimed is:

1. A connector, comprising:

a housing assembly which comprises a female housing provided with an outer surface and at least one terminal insertion opening, and a male housing which is fittable on the outer surface of the female housing;

at least one terminal fitting inserted into the female housing through the terminal insertion opening;

at least one wire connected with the terminal fitting and drawn out of the female housing through the terminal insertion opening, a substantially tubular cover mounted on the housing assembly such that the tubular cover substantially covers the terminal insertion opening, the terminal fitting therein and at least portions of the wire, the cover comprising a pair of half-piece members which are assembled together to hold the wire therebetween, and a first seal member for sealing clearances between the cover and the housing assembly and a second seal member for sealing clearances between the cover and the wire.

2. A connector according to claim 1, wherein the seal members are gelatinous seal members.

3. A connector according to claim 2, wherein the male housing has an outer surface and at least one rib on the outer surface, the cover having at least one inwardly projecting engaging portion engaging the rib of the male housing, the first seal member (40C) being in proximity to the rib and the engaging portion.

4. A connector according to claim 3, wherein the engaging portion is engageable with the seal member in a direction arranged at an angle different from 0° and 180° with respect to a mounting direction of the cover with the housing assembly.

5. A connector according to claim 4, wherein the cover is fittable on an outer surface of the male housing.

6. A connector according to claim 1, further comprising a gelatinous seal member arranged between corresponding contact portions of the half-piece members.

7. A connector according to claim 1, wherein the at least one terminal insertion opening comprises a plurality of terminal insertion openings, the connector comprising a plurality of terminal fittings mounted respectively in the terminal insertion openings and a plurality of wires connected respectively with the terminal openings, the connector further comprising an aligning member for aligning the wires substantially side by side at substantially specified spacings.

8. A connector according to claim 7, wherein the cover comprises positioning means for positioning the housing assembly and the aligning member in a specified position.

9. A connector according to claim 8, wherein the positioning means positions the aligning member in such a position that at least one wire is held in alignment with a wire opening through which the wires are drawn from the cover.

10. A connector, comprising:

a housing provided with at least one terminal insertion opening and an outer surface, at least one terminal fitting at least partially inserted into the housing through the terminal insertion opening, and at least one wire connected with the terminal fitting and drawn out of the housing through the terminal insertion opening, a substantially tubular cover mounted on the housing, the cover comprising a pair of half-piece members assembled to hold the wires therebetween and substantially covering the terminal insertion opening, the terminal fitting therein and at least a portion of the wire, the cover having at least one inwardly directed engaging portion for engagement with the outer surface of the housing, and at least a first seal member for sealing clearances between the cover and the housing and at least a second seal member for sealing clearances between the cover and the wire.

11. A connector according to claim 10, wherein the seal members are gelatinous seal members.

12. A connector according to claim 10, further comprising at least a third seal member arranged between corresponding contact portions of the half-piece members.

13. A connector according to claim 10, wherein the at least one terminal insertion opening comprises a plurality of terminal insertion openings, the connector comprising a plurality of terminal fittings mounted respectively in the terminal insertion openings and a plurality of wires connected respectively with the terminal openings, the connector further comprising an aligning member for aligning the wires substantially side-by-side at substantially specified spacings.

14. A connector according to claim 13, wherein the cover comprises positioning means for positioning the housing and the aligning member in a specified position.

* * * * *